US011274639B1

(12) United States Patent
Lohr et al.

(10) Patent No.: US 11,274,639 B1
(45) Date of Patent: Mar. 15, 2022

(54) ENGINE INTAKE MANIFOLD WITH INTERNAL RIBS

(71) Applicant: Ford Global Technologies, LLC, Dearborn, MI (US)

(72) Inventors: John Lohr, Beverly Hills, MI (US); Murray Griffin, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/142,984

(22) Filed: Jan. 6, 2021

(51) Int. Cl.
*F02M 35/10* (2006.01)
*F02M 35/104* (2006.01)

(52) U.S. Cl.
CPC .... *F02M 35/104* (2013.01); *F02M 35/10026* (2013.01); *F02M 35/10072* (2013.01); *F02M 35/10262* (2013.01); *F02M 35/10321* (2013.01)

(58) Field of Classification Search
CPC ..... F02M 35/104; F02M 35/10026; F02M 35/10072; F02M 35/10262; F02M 35/10347; F02M 35/10327; F02M 35/10118; F02M 35/10321; B29C 64/10
See application file for complete search history.

(56) References Cited

U.S. PATENT DOCUMENTS

| | | | | |
|---|---|---|---|---|
| 5,662,079 | A | 9/1997 | Snider | |
| RE40,621 | E | 1/2009 | Choi | |
| 8,607,756 | B1 | 12/2013 | Kulkarni et al. | |
| 8,955,485 | B2 | 2/2015 | Kulkarni | |
| 2014/0165951 | A1* | 6/2014 | Moetakef | F02M 35/1277 123/192.1 |
| 2017/0175688 | A1* | 6/2017 | Nola | F02M 35/10242 |
| 2018/0058401 | A1* | 3/2018 | Zouani | F02M 35/1277 |
| 2019/0219008 | A1* | 7/2019 | Wicks | F02M 35/10118 |

FOREIGN PATENT DOCUMENTS

| | | | |
|---|---|---|---|
| EP | 0021706 | A1 | 1/1981 |
| JP | 2008045432 | A | 2/2008 |
| JP | 4556864 | A | 10/2010 |
| JP | 2012225331 | A | 11/2012 |
| WO | 2014209046 | A1 | 12/2014 |

* cited by examiner

*Primary Examiner* — Syed O Hasan
(74) *Attorney, Agent, or Firm* — Geoffrey Brumbaugh; McCoy Russell LLP

(57) ABSTRACT

Methods and systems are provided for modified intake runners including ribs in the direction of airflow. In one example, a system may include an intake manifold adapted to couple to an intake port via an intake runner. Internal to the intake runner, a plurality of negative ribs may be arranged along a direction of air flow on a façade of an inner portion.

13 Claims, 6 Drawing Sheets

ENGINE INTAKE MANIFOLD WITH INTERNAL RIBS

FIELD

The present description relates generally to methods and systems for modified intake runners including ribs in the direction of airflow.

BACKGROUND/SUMMARY

In internal combustion engines, air is introduced into an intake manifold via an intake throttle. The intake manifold may typically consist of a plenum and intake runners. The intake runners further channel airflow from a first end of the intake runner proximal to the plenum into the engine cylinders through a second end proximal to an intake port of a cylinder. Shapes of such intake runners are adapted for improved flow pressure and air flow dynamics through the runners. In order to attain a desired shape for airflow through the intake runner, multiple molded components (shells) are welded together.

Various approaches have been developed to improve flow dynamics in an engine intake manifold. One example approach is shown by Kulkarni in U.S. Pat. No. 8,955,485. Therein, Kulkarni introduces an inlet with two radial indentations on opposite sides leading from the throttle to the plenum, in order to optimize flow in such a way to reduce noise, vibration, and harshness. The inlet maintains a wall thickness along the portion of the inlet where the radial indentations are disposed, thereby introducing no further bulk. Kulkarni also introduced a network of protruding ribs in a substantially cross-hatched manner along the intake manifold, in order to provide strength and stiffness of the intake manifold, in addition to further reducing noise, vibration, and harshness.

However, the inventors herein have recognized potential issues with such systems. While the systems of Kulkarni in U.S. Pat. No. 8,955,485 reduce noise, vibration, and harshness, they continue to rely on welding multiple, potentially thick shells together to form the intake manifold. Typically, these shells may be manufactured through injection molding. A limiting factor in the injection molding process is the processing (such as cooling) time which significantly depends on spatial dimensions (such as thickness) of the shell. Consequently, if the shell thickness is greater at certain points, manufacturing of the runners with thicker portions may be inefficient and cost ineffective. Further, stacking of layers of shells may cause thick sections in the welded shells, which adds excess weight to the intake manifold, in addition to added manufacturing costs.

In one example, the issues described above may be addressed by a system for an engine, comprising: an intake manifold adapted to couple to an intake port via an intake runner; and a plurality of negative ribs arranged on a façade of an inner portion of the intake runner. In this way, by introducing negative ribs in a direction of airflow, thickness of the intake manifold may be reduced without adversely affecting airflow through the intake runner.

As one example, for each intake runner, negative ribs may be formed along a segment in an inner portion (such as core region) of the intake runner. The segment may include a façade perpendicular to the direction of airflow proximal to the second end of the runner proximal to the cylinder. A plurality of vertical, negative ribs may be formed on the façade and a recess may be formed below the façade. Air may flow through the intake runner from the first end of the runner proximal to the throttle, to the second end of the runner proximal to the intake port of a cylinder, with the negative ribs in the direction of airflow. As air flows into the cylinder, the air may flow through the recess formed below the façade as it enters the cylinder through the intake valve. The plurality of ribs of variable length and curvature may be formed by conventional injection molding.

The inventors have recognized that the above approach may provide various advantages. In this way, by adding negative ribs to a façade in in inner portion of each intake runner, weight of each intake runner may be reduced. Further, use of conventional injection molding for forming the negative ribs allows for greater flexibility in design adaptation for optimal airflow. The addition of negative ribs allows for minimal increase in manufacturing complexity, while reducing weight and material cost. The technical effect of introducing negative ribs along the direction of flow above a recess in the intake runner is that the flow dynamics of air entering the engine cylinders may be improved. Overall, by substituting thicker, multi-layered welded sections in an inner portion of an intake runner with thinner, negative ribs, weight, and cost of an engine component may be reduced without any significant adverse effect on power and torque of the engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-6 are shown approximately to scale

DETAILED DESCRIPTION

Figure 1:
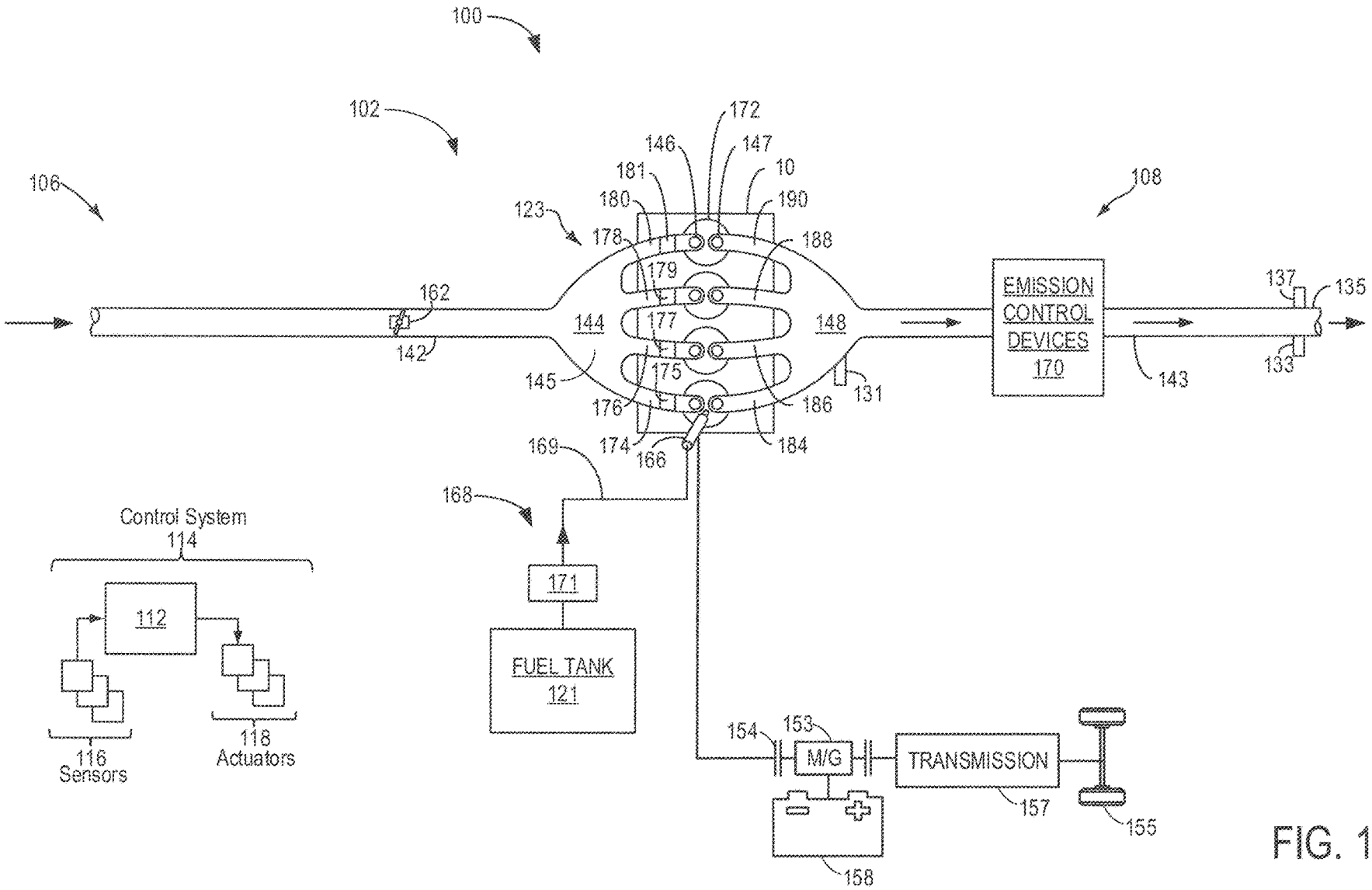
FIG. 1 shows an engine system including modified intake runners.
Figure 2:
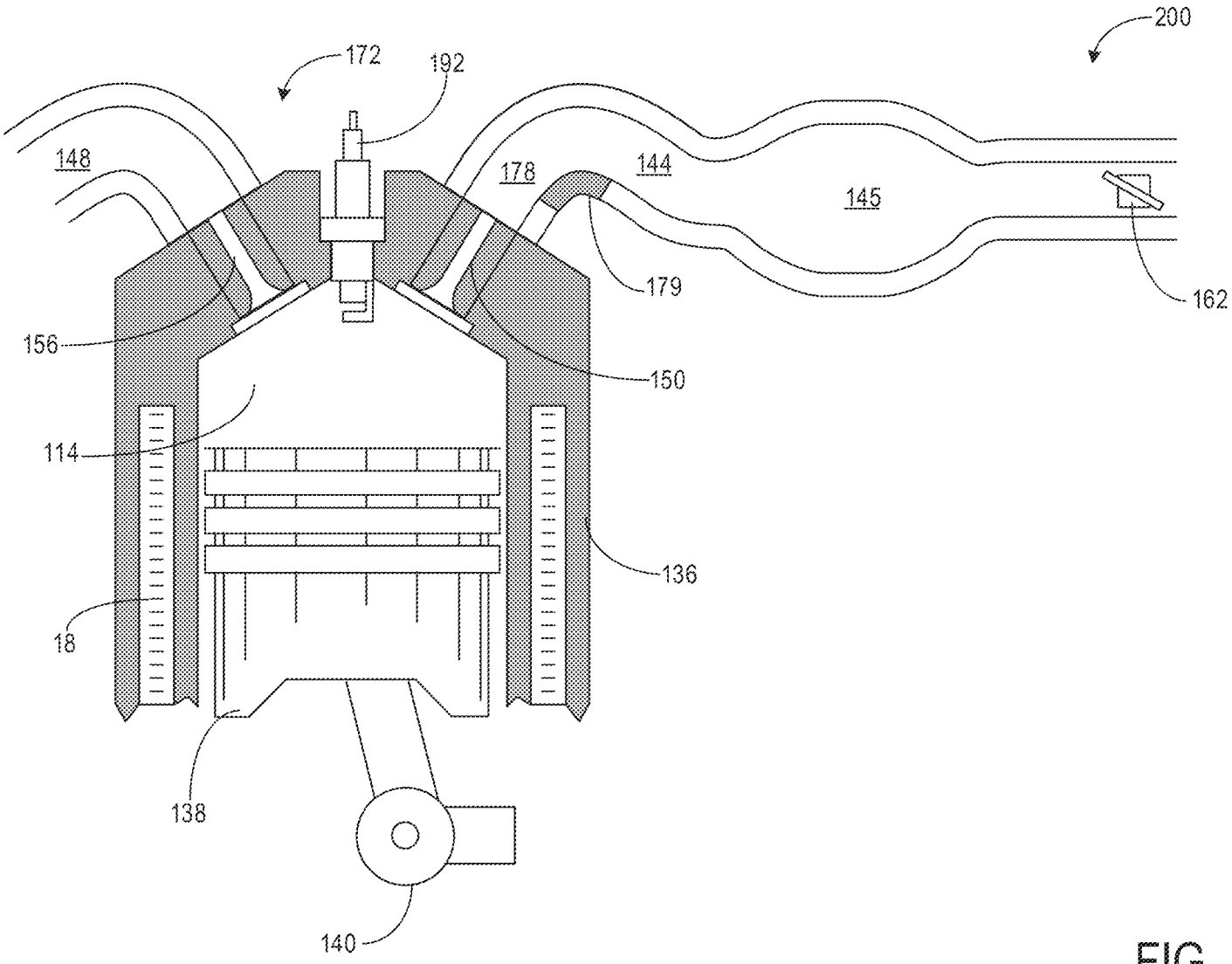
FIG. 2 shows a cylinder of the engine system of FIG. 1 coupled to the modified intake including negative ribs.
Figure 4:
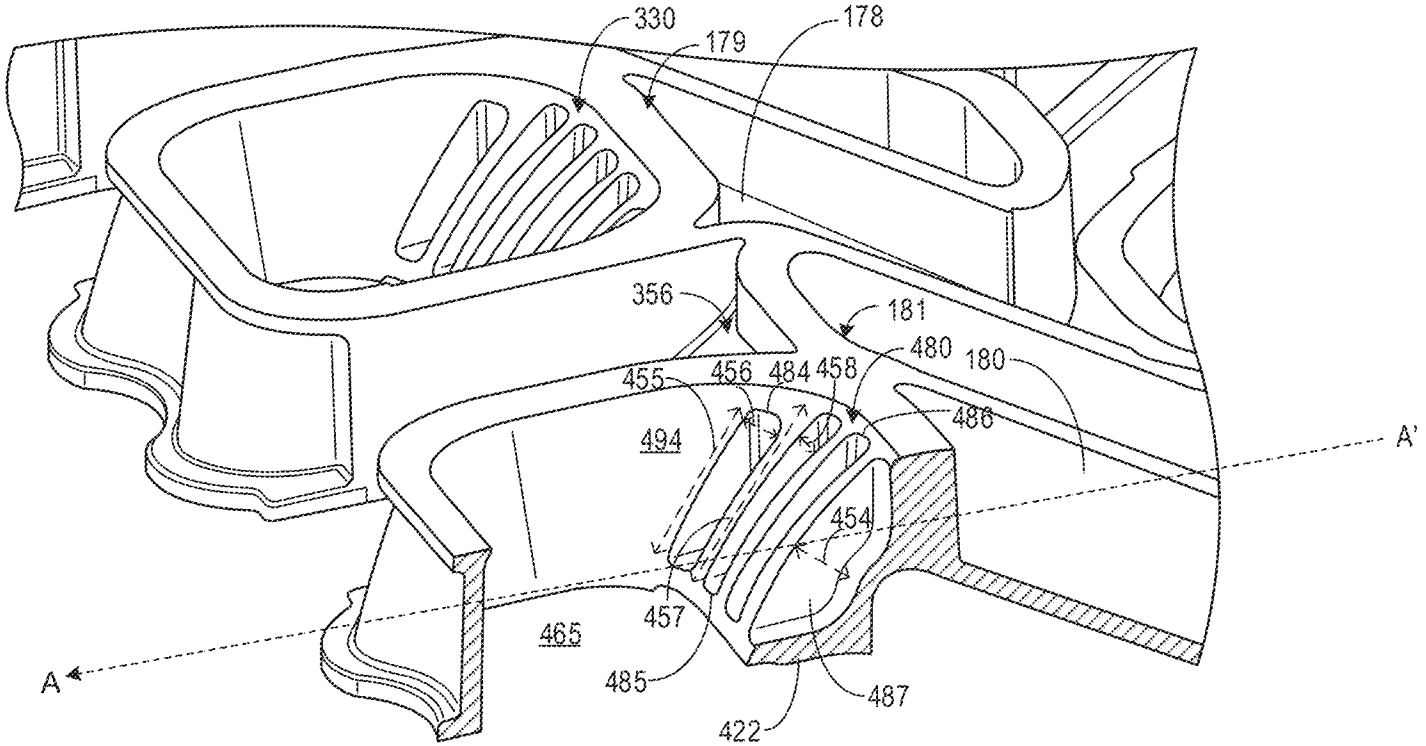
FIG. 4 shows a first cross-sectional view of a modified intake runner including negative ribs.
Figure 5:
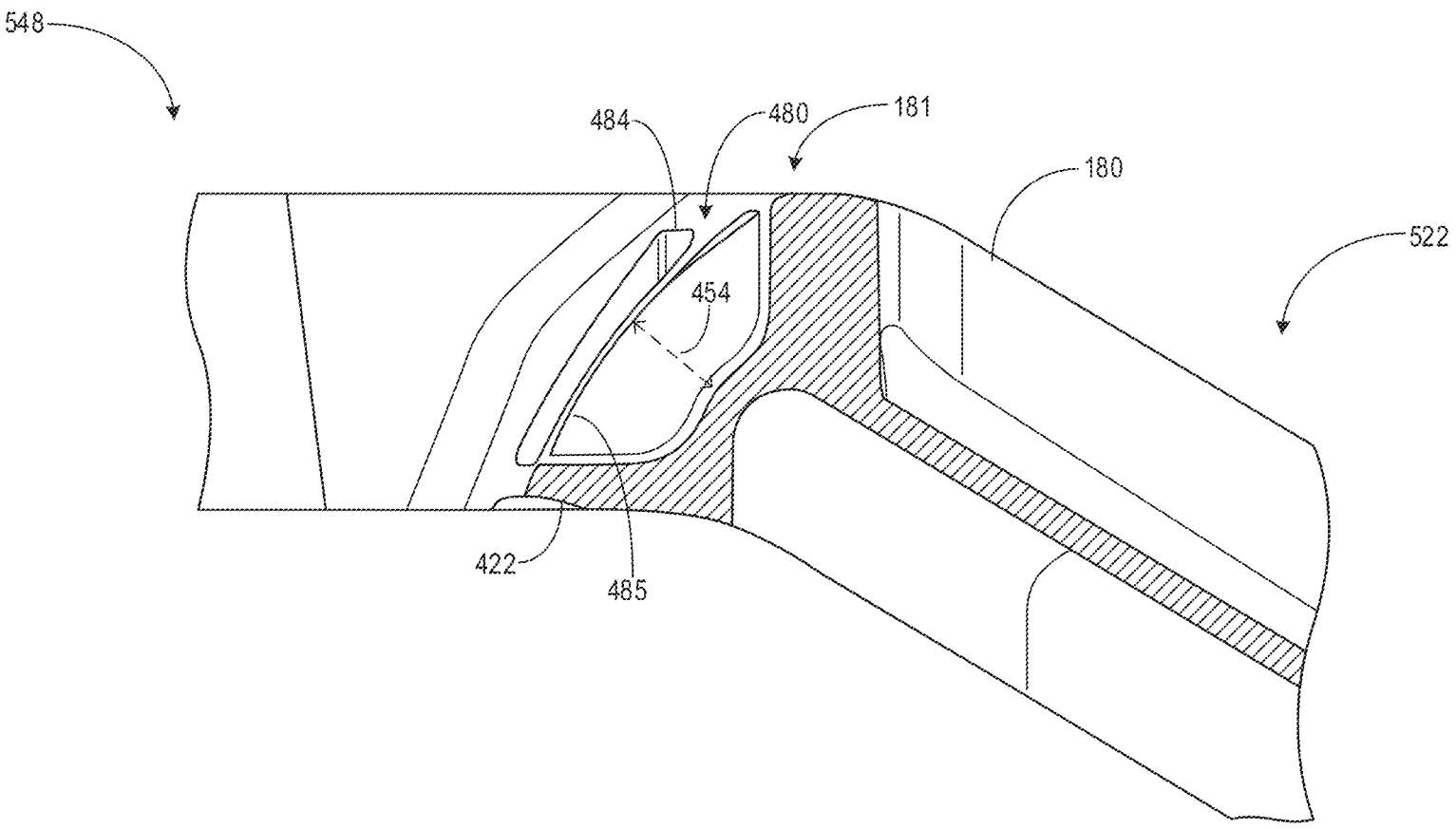
FIG. 5 shows a side view of a cross-section of the modified intake runner including the negative ribs.
Figure 6:
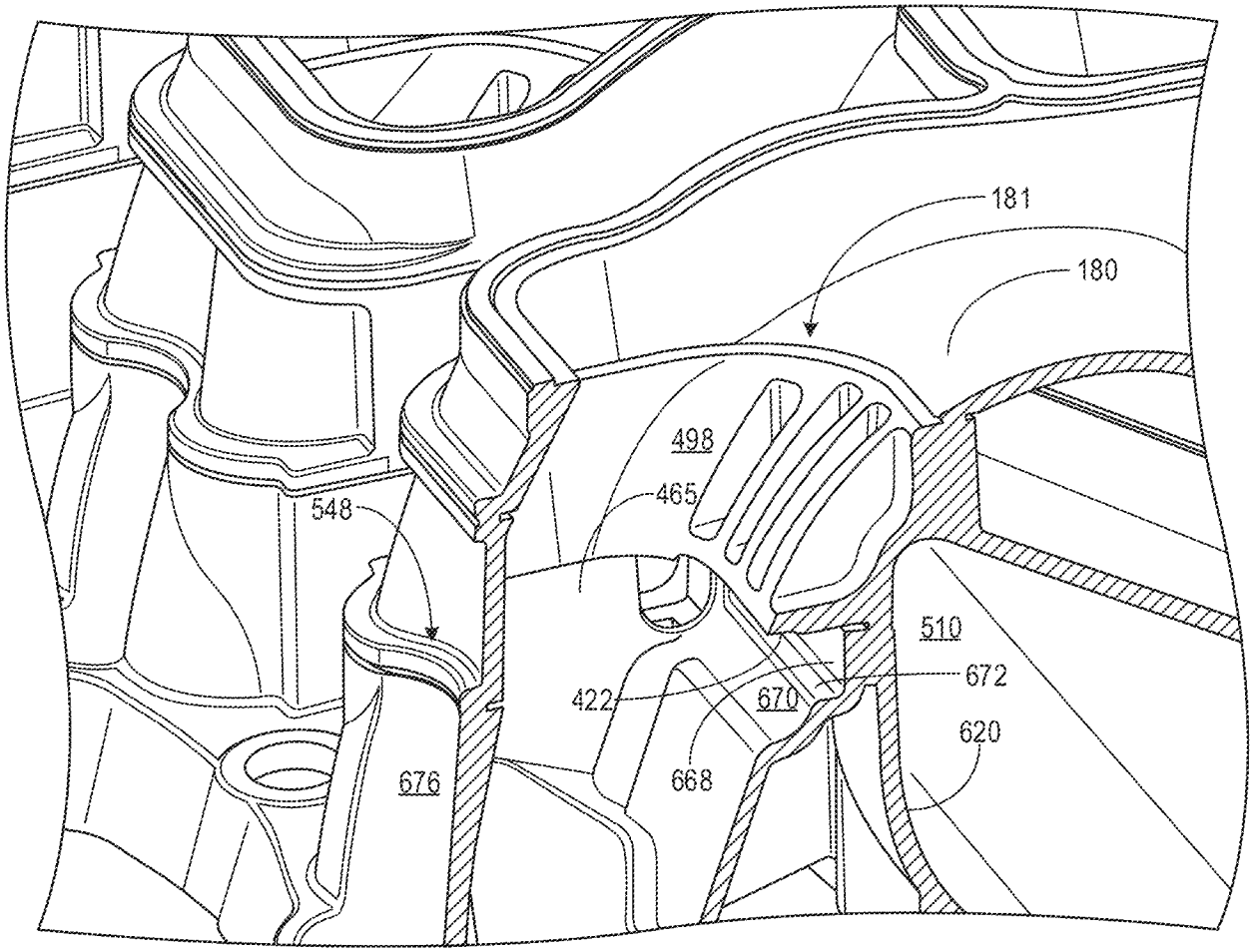
FIG. 6 shows a perspective view of a section of the modified runners including the negative ribs formed on the façade positioned above a recess.

The following description relates to systems and methods for a modified intake manifold of an engine including modified intake runners with negative ribs. An example engine system including the modified intake runners coupled to each engine cylinder is shown in FIG. 1. An intake manifold of the engine includes a plenum and a plurality of intake runners positioned between the plenum and respective intake ports of each cylinder. A single cylinder of the engine system including the modified intake runner is shown in FIG. 2. Segments of each intake runner may include negative ribs formed on a façade as shown FIG. 3. FIGS. 4-6 show further detail of the inner portion of the intake runners including a recess formed below the façade with the negative ribs facilitating airflow through the intake runners.

FIG. 1 shows a schematic depiction 100 of a vehicle system 102 that can derive propulsion power from engine system 106. Engine system 106 may include an engine 10 containing four cylinders 172. Engine 10 includes an engine intake 123 and an engine exhaust 108. Engine intake 123 includes an air intake throttle 162 fluidly coupled to the engine intake manifold 144 via an intake passage 142. The intake manifold 144 consists of a plenum 145, and four intake runners 174, 176, 178, and 180. In this example, four engine cylinders 172 are shown with each cylinder including an intake valve 146 and an exhaust valve 147. Each intake runner may couple the plenum 145 of the intake manifold to respective intake valves of the engine cylinders. Each of the intake runners 174, 176, 178, and 180 may include modified inner portions (also herein referred to as core region or internal portion) 175, 177, 179, and 181 respectively, to facilitate flow of air from the plenum 145 to the respective intake valves.

Each of the modified inner portions (such as respective portions 175,177, 179, and 181) of each intake runner may include a façade formed between an arcuate upper edge and an arcuate lower edge. The façade may be angled and may extend along a curvature of the arcuate upper edge and a plurality of negative ribs may be arranged on a façade. Along the façade, each rib of the plurality of ribs may include an elongated, rectangular indentation penetrating into a thickness of the façade. The plurality of ribs may include four central ribs and two peripheral ribs, a peripheral rib formed on each side of the central ribs. Each of the four central ribs may be identical in length, width, and thickness; and wherein each of the two peripheral ribs are identical in length, width, and thickness, while a first length of a central rib is greater than a second length of a peripheral rib, and a first width of the central rib is lower than a second width of the peripheral rib. A ledge may be formed at a base of the façade, the ledge jutting onto a base region of the inner portion, and a recess may be formed between the ledge and an inner wall of the inner portion. Intake gas may flow from the intake manifold to the intake port over the ribs and through the recess formed under the façade.

Engine exhaust 108 includes an exhaust manifold 148 leading to an exhaust passage 135 that routes exhaust gas to the atmosphere. The exhaust manifold 148 channels exhaust gas from the cylinders 172 via the exhaust valves 147 into respective exhaust runners 184, 186, 188, and 190. Engine exhaust 108 may include one or more emission control devices 170 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 100 is a boosted engine system, the engine system may further include a boosting device, such as a turbocharger (not shown).

Engine system 106 is coupled to a fuel system 168. Fuel system 168 includes a fuel tank 121 coupled to a fuel pump 171, the fuel tank supplying fuel to an engine 10 for combustion in the engine cylinders. Fuel pump 171 is configured to pressurize fuel delivered to the injectors of engine 10, such as example injector 166. While only a single injector 166 is shown, additional injectors are provided for each cylinder.

Vehicle system 102 may further include control system 114. Control system 114 is shown receiving information from a plurality of sensors 116 (various examples of which are described herein) and sending control signals to a plurality of actuators 118 (various examples of which are described herein). As one example, sensors 116 may include exhaust gas sensor 131 located upstream of the emission control device, temperature sensor 133, and pressure sensor 137. Other sensors such as additional pressure, temperature, air/fuel ratio, and composition sensors may be coupled to various locations in the vehicle system 102. As another example, the actuators may include fuel injector 166, and throttle 162.

Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, vehicle system 102 may be a hybrid vehicle system with multiple sources of torque available to one or more vehicle wheels 155. In other examples, vehicle system 102 is a conventional vehicle with only an engine, or an electric vehicle with only electric machine(s). In the example shown, vehicle system 102 includes engine 10 and an electric machine 153. Electric machine 153 may be a motor or a motor/generator. Crankshaft of engine and electric machine 153 are connected via a transmission 157 to vehicle wheels 155 when one or more clutches 154 are engaged. In the depicted example, a first clutch 154 is provided between crankshaft and electric machine 153, and a second clutch 154 is provided between electric machine 153 and transmission 157. Controller 112 may send a signal to an actuator of each clutch 154 to engage or disengage the clutch, so as to connect or disconnect crankshaft from electric machine 153 and the components connected thereto, and/or connect or disconnect electric machine 153 from transmission 157 and the components connected thereto. Transmission 157 may be a gearbox, a planetary gear system, or another type of transmission. The powertrain may be configured in various manners including as a parallel, a series, or a series-parallel hybrid vehicle.

Electric machine 153 receives electrical power from a traction battery 158 to provide torque to vehicle wheels 155. Electric machine 153 may also be operated as a generator to provide electrical power to charge battery 158, for example during a braking operation.

FIG. 2 shows an example embodiment 200 of a single cylinder system 172 of the plurality of cylinders in FIG. 1. The cylinder 172 may be coupled to each of an intake manifold 144 and an exhaust manifold 148 via respective runners. The cylinder system 172 includes a combustion chamber (also referred herein as cylinder) 14 which further includes combustion chamber walls 136 with piston 138 positioned therein. The combustion chamber walls may include cooling sleeves 18 to facilitate dissipation of heat generated during combustion. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10. Combustion chamber 14 is shown including at least one intake valve 150 and at least one exhaust valve 156 located at an upper region of combustion chamber 14.

During combustion in the combustion chamber 14, air may enter the intake manifold 144 through the intake throttle 162, passing through a plenum 145 and then flowing to the intake valve 150 via an intake runner 178. The intake runner may include an inner portion (core) 179 formed with negative ribs along the direction of airflow. Details of the structure of the inner portion 179 are shown in FIGS. 3-6.

The cylinder may, for example, operate in a standard four-stroke cycle as part of the engine 10. A four-stroke cycle consists of an intake stroke, a compression stroke, a power stroke, and an exhaust stroke. During the four-stroke cycle, air may enter the combustion chamber an air/fuel mixture and be ignited by a spark plug 192. Upon combustion within the combustion chamber, the residual gas may then be expelled as exhaust through the exhaust valve 156 and the exhaust passage 148.

Figure 3:
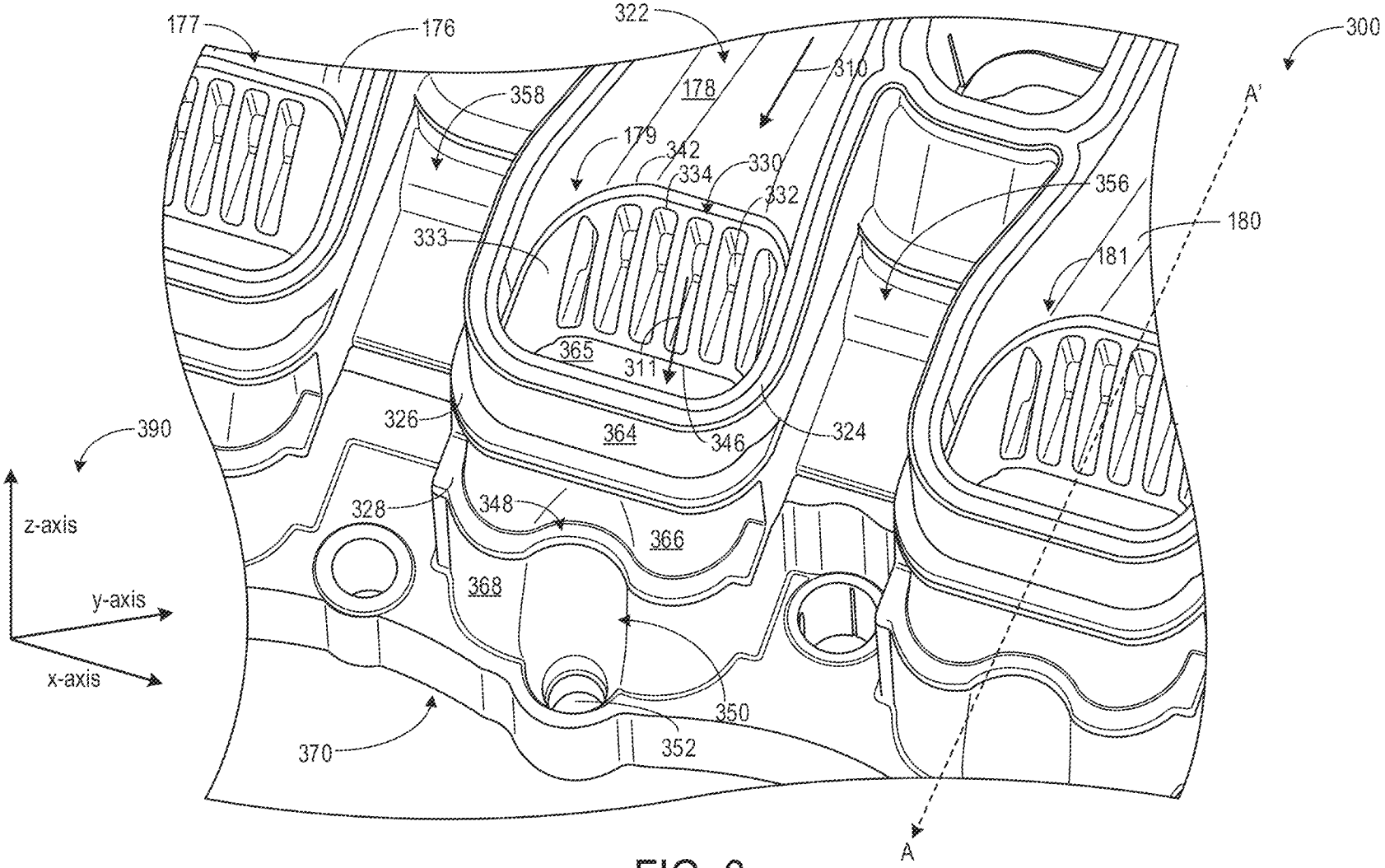
FIG. 3 shows a perspective view of an example embodiment of ribbed segments within the modified intake runners.

FIG. 3 shows a perspective view 300 of an example embodiment of ribbed segments within modified intake runners in an intake manifold (such as the intake manifold 144 in FIG. 1). The perspective view 300 shows an inner structure of the modified intake runners with a top cover portion removed from over the intake runners. As an example, the ribbed segment in an intake runner may correspond to the inner portion 179 in FIGS. 1 and 2 respectively. As shown in FIG. 1, the plenum of the intake manifold may diverge to form a plurality of intake runners. As an example, a second intake runner 178 may be separated from a first intake runner 180 by a first partition 356. Similarly, a second partition 358 may separate a third intake runner 176 and the second intake runner 178. Each of the first partition 356 and the second partition 358 may be formed as ridges between two successive intake runners.

In this example, inner portion 179 within the second intake runner 178 is discussed in detail, however, each intake runner including a first intake runner 180 and a third intake runner 176 may comprise substantially identical ribbed inner portions (first inner portion 181 and second inner portion 177).

The second intake runner 178 may include a first end 322 proximal to and emanating from a plenum (such as 145 of FIG. 1) of the intake manifold, an inner portion 179, and a second end 348 proximal to a housing 350 for an intake valve (such as intake valve 150 of FIG. 2). Air entering through the intake throttle may flow from the plenum of the intake manifold and then flow through each of the combustion chambers via respective intake runners. As an example, as shown by arrows 310 and 311, air may enter the second runner 178 via the first end 322 and then flow through the second inner portion 179, and the second end 348 before reaching the intake port 352. The second inner portion 179 may include a second segment 330 with a second façade 333 (also referred herein as wall) formed between an arcuate upper edge 342 proximal to the first end 322 and an arcuate lower edge 346 proximal to the second end 348. The façade may be formed along a plane at an angle relative to the x-z plane of coordinate system 390. As an example, the angle of the façade may be between 10-45 degrees relative to the y-z plane. The curvature of the arcuate upper edge 342 may be greater than the curvature of arcuate the lower edge 346. The edge of the second runner 178 may be lined by the rim 324 which extends along the perimeter of the second runner 178. A top portion of the second runner 178 (removed in this figure) may be posited with face sharing contact with the rim 324. In this way, the inner portion of the intake runner may include a rim lining the perimeter of the intake runner, a plurality of vertically stacked segments, and an intake port formed at a second end of the intake runner, a first end of the intake runner being proximal to the plenum.

The façade may be arcuate and follow the curvature of the upper edge 342. The façade may have a higher cross-sectional area at the upper edge 342 with tapering sides. Said another way, the façade 333 of the second inner portion 179 including the one or more negative ribs may be arcuate with a width of the façade being higher at a center of the wall and the width of the wall decreasing towards two ends. In one example, the façade 333 may be angled along the direction of airflow indicated by arrow 311. The second segment 330 may further include an open base area 365 positioned directly below the façade 333. Air may flow to the second end 348 of the second runner 178 via the base area 365.

The façade 333 may include a plurality of negative ribs formed within the façade. In this example, six evenly spaced ribs 334 are shown. However, in alternate embodiments, there may be lower or higher number of ribs. Each rib 334 may be a negative rib such as an indentation formed into the façade 333. Each rib 334 may be a rectangular, elongated negative indentation (along the z-axis of the coordinate system 390) with a central opening 332 lined with four walls projecting inwards into the façade 333. Air may flow over the ribs and also through the central opening 332.

The plurality of ribs 334 may include four central ribs which are identical and two peripheral ribs which may be shortened relative to the central ribs. In this way, the negative ribs may include a first set of coplanar central ribs and a second set of peripheral ribs, each rib in the first set of coplanar central ribs being longer than each rib in the second set of peripheral ribs. As one example, the height of the peripheral ribs may be 80% of that of the central ribs. The plurality of ribs 334 may be formed by injection molding. The technical effect of the addition of a plurality of ribs 334 is the elimination of thicker sections in the intake manifold runners, which reduces complex manufacturing procedures.

The inner portion of intake runner 179 may be formed of three stacked segments, which are stacked along the z axis. The three stacked shells may be welded together by ultrasonic welding. The stacked segments may include a first section 364 positioned directly below the rim 324 (along the direction of negative z-axis). A second section 366 may be positioned vertically below (along the direction of negative z-axis) the first section 364, the second section 366 separated from the first section 364 via a first flange 326. An additional third section 368 may be positioned vertically below (along the direction of negative z-axis) the second section 366, and the third section 368 may be separated from the second section 366 via a second flange 328. Each end of the arcuate upper edge 342 of the second segment 330 is coplanar with the first flange 326 and may end at the first flange 326. Additionally, the arcuate lower edge 346 is coplanar with a second flange 328 and may end at the second flange 328. As an example, the façade 333 may be positioned vertically below (along the direction of negative z-axis) the first flange 326, between the first flange 326 and the second flange 328. Each of the rim 324, first section 364, the flange 326, and the second section 366 may have a substantially similar curvature with the first section 364.

The airflow from the intake runner 178 to a cylinder (such as cylinder 172 of FIG. 2) is regulated by an intake valve. The intake valve may be housed within an intake valve housing 350 formed at the second end 348 of the intake runner 178. The intake valve housing 350 may be defined by an elongated concave indentation on the outer wall of the third section 368 which extends along the height of the third section 368 and the housing 350 may include an intake port 352 at formed at a base 370 of the manifold. The intake valve may be placed within the housing 350 and inserted through the intake port 352 allowing regulated airflow into the cylinder. In this way, the structure of an intake manifold may include a plenum coupled to a plurality of intake runners, each intake runner including negative ribs formed along a wall of an inner portion of the intake runner, and a recess formed under the wall allowing air flow from the plenum to an intake port of a cylinder.

FIGS. 4-6 show a plurality of views highlighting details of the inner portions of the intake runners such as first inner portion 181 within the first intake runner 180. In particular, FIG. 4 shows the first intake runners 180 and the second intake runner 178 including a cross-sectional view of the first inner portion 181 of first intake runner 180. The cross-section of the first intake runner 180 may be taken along the A' A axis as shown in FIGS. 3-4.

Similar to the second inner portion 179 of the second intake runner 178 as described in FIG. 3, the first inner portion 181 of the first intake runner 180 may include a first segment 480 with a plurality of negative ribs formed along a first façade 494. Each of the second segment 330 of the second intake runner 178 and the first segment 480 of the first intake runner 180 may be substantially rectangular or square shapes with rounded edges. The first façade 494 including the plurality of ribs may form one side of the rectangular or square shape of the first segment 480 while the other three sides remain solid without any ribs or indentations. The plurality of ribs may include a first rib 484, a second rib 485, a third rib 486, a fourth rib 487, a fifth rib (not shown), and a sixth rib (not shown). The first rib 484 and the sixth rib may be symmetric (mirror symmetry) and may form the peripheral ribs. The height and width of the peripheral ribs is indicated by arrows 455 and 456, respectively. The second rib 485, third rib 486, fourth rib 487, and the fifth rib may be identical in shape and size and may form the central ribs. The height and width of the central ribs is indicated by arrows 457 and 458, respectively. As an example, the height (shown by arrow 455) of the peripheral ribs may be 80% of the height (shown by arrow 457) of the central ribs, while the width (shown by arrow 458) of the central ribs may be 60% of the width (shown by arrow 456) of the peripheral ribs. The central ribs may have a trapezoidal cross-section (along the direction of the arrow 454). Each rib may be formed as a negative rib penetrating into the façade. A thickness/depth of the fourth rib 487 is shown by arrow 454. FIG. 5 shows a side view 500 of a cross-section of the inner portion 181 of the first intake runner 180. In the side view 500, a thickness of a second rib 485 (central rib) is indicated by the arrow 454. Further, as seen from the side-view 500, the first intake runner be angled upwards from a first end 522 towards a second end 548.

As seen from the cross-sectional view of the façade 498, a ledge 422 may be formed under the façade 498. The ledge 422 may jut out onto the open base area 465. As will be elaborated with reference to FIG. 6, a recess is formed between an inner wall of a stacked section of the inner portion of the intake runner.

FIG. 6 shows a perspective view 600 of a section of the first intake runner 180, including the inner structure of the second end 548. The ledge 422 jutting out to the open base area 465 is shown under the façade 498. The ledge 422 is formed at the base of the façade with the ribs formed on the façade ending at the upper surface of the ledge. A recess 668 is formed between an inner wall 670 of the stacked sections of the first inner portion 181 and the ledge. The inner wall 670 of the inner portion may include one or more steps such as a first step 672 in the direction of the open base area 465. The U-shaped recess 668 may be defined by a lower surface of the ledge 422, a first step 672 on the inner wall 670 and a straight portion of the inner wall 670 between the ledge 422 and the first step 672. Although shown in one intake runner, corresponding ledges and recesses may be formed at each intake runner in the engine. Said another way, the recess 668 may be formed between a base of the wall and another wall of vertically stacked segments of the inner portion 181, the base of the wall projecting outward towards the second end of the intake runner from the another wall of the vertically stacked segments. The recess 668 may be described as a rectangular area formed between a lower surface of the façade 498 and an inner wall 670 of the inner portion of the intake runner Due to the presence of the recess 668, as air flows into an intake valve of the cylinder via the inner portion of an intake runner, the air may flow through the recess formed below the façade. The combination of the ribs and the recess may improve the flow dynamics of air and allow improved air flow into the cylinder.

In this way, air in the intake system may flow from a plenum of an intake manifold to an intake port of a cylinder via each of a plurality of negative ribs formed on a façade of an inner portion of an intake runner and a recess formed below the façade of the inner portion. The addition of negative ribs within an inner portion of the intake runners may have several advantages. The technical effect of the production of negative ribs is to reduce excess material use within the intake runners of the intake manifold without sacrificing air flow dynamics. Typically, the intake manifold may be manufactured through the stacking of several shells formed through injection molding, which may then be sonically welded together. During the injection molding process, cooling time is a limiting time scale, which depends significantly on spatial dimensions (such as thickness). Additionally, during the manufacturing process, several shells may be ultrasonically welded together, which may create thick portions within the intake runners. Previous solutions modified thick portions in subsequent manufacturing processes to reduce excess thickness. Therefore, addition of negative ribs may reduce the cooling time and remove the need for subsequent manufacturing processes, reducing manufacturing time and cost. An additional technical effect of the addition of negative ribs is to allow for further range of design in the shape of the intake runner, allowing for greater airflow optimization with negligible effect on power and torque.

In one example, a system for an engine in a vehicle, comprises: an intake manifold adapted to couple to an intake port via an intake runner, and a plurality of negative ribs arranged on a façade of an inner portion of the intake runner. In the preceding example, additionally or optionally, the intake runner adapted to flow intake gas from the intake manifold to a cylinder via the negative ribs and the intake port. In any or all of the preceding examples, additionally or optionally, the inner portion of the intake runner includes the façade formed between an arcuate upper edge and an arcuate lower edge. In any or all of the preceding examples, additionally or optionally, the façade is angled and extends along a curvature of the arcuate upper edge. In any or all of the preceding examples, additionally or optionally, each rib of the plurality of ribs include an elongated, rectangular indentation penetrating into a thickness of the façade. In any or all of the preceding examples, additionally or optionally, the plurality of ribs include four central ribs and two peripheral ribs, a peripheral rib formed on each side of the central ribs. In any or all of the preceding examples, additionally or optionally, each of the four central ribs are identical in length, width, and thickness; and each of the two peripheral ribs are identical in length, width, and thickness. In any or all of the preceding examples, additionally or optionally, a first length of a central rib is greater than a second length of a peripheral rib, and a first width of the central rib is lower than a second width of the peripheral rib. In any or all of the preceding examples, additionally or optionally, the system further comprising, a ledge formed at a base of the façade, the ledge jutting onto a base region of the inner portion, and a recess formed between the ledge and an inner wall of the inner portion. In any or all of the preceding examples, additionally or optionally, intake gas flows from the intake manifold to the intake port over the ribs and through the recess formed under the façade. In any or all of the preceding examples, additionally or optionally, the engine includes a plurality of the intake runners with each intake runner including the plurality of negative ribs arranged on the façade of the inner portion of the intake runner.

In another example, a system for an engine in a vehicle, comprises: an intake manifold including a plenum coupled to a plurality of intake runners, each intake runner including negative ribs formed along a wall of an inner portion of the intake runner and a recess formed under the wall allowing air flow from the plenum to an intake port of a cylinder. In the preceding example, additionally or optionally, the inner portion of the intake runner includes a rim lining the perimeter of the intake runner, a plurality of vertically stacked segments, and an intake port formed at a second end of the intake runner, a first end of the intake runner being proximal to the plenum. In any or all of the preceding examples, additionally or optionally, the wall of the inner portion including the one or more negative ribs is arcuate with a width of the wall being higher at a center of the wall and the width of the wall decreasing towards two ends. In any or all of the preceding examples, additionally or optionally, the recess is formed between a base of the wall and another wall of the vertically stacked segments, the base of the wall projecting outward towards the second end of the intake runner from the another wall of the vertically stacked segments. In any or all of the preceding examples, additionally or optionally, negative ribs include a first set of coplanar central ribs and a second set of peripheral ribs, each rib in the first set of coplanar central ribs being longer than each rib in the second set of peripheral ribs. In any or all of the preceding examples, additionally or optionally, six negative ribs are formed along the wall of the inner portion of the intake runner.

In yet another example, a method for an engine in a vehicle, comprising: flowing air from a plenum of an intake manifold to an intake port of a cylinder via each of a plurality of negative ribs formed on a façade of an inner portion of an intake runner and a recess formed below the façade of the inner portion. In the preceding example, additionally or optionally, each negative rib includes a trapezoidal cross section along a direction of air flow, each negative rib extending through a thickness of the façade. In any or all of the preceding examples, additionally or optionally, the recess is a rectangular area formed between a lower surface of the façade and an inner wall of the inner portion of the intake runner.

FIGS. 3-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine, comprising: an intake manifold adapted to couple to an intake port via an intake runner; a plurality of negative ribs arranged on a façade of an inner portion of the intake runner, wherein the inner portion of the intake runner includes the façade formed between an arcuate upper edge and an arcuate lower edge, wherein the façade is angled and extends along a curvature of the arcuate upper edge, and wherein each rib of the plurality of negative ribs include an elongated, rectangular indentation penetrating into a thickness of the façade.

2. The system of claim 1, wherein the intake runner is adapted to flow intake gas from the intake manifold to a cylinder via the plurality of negative ribs and the intake port.

3. The system of claim 1, wherein the plurality of ribs include four central ribs and two peripheral ribs, a peripheral rib formed on each side of the central ribs.

4. The system of claim 3, wherein each of the four central ribs are identical in length, width, and thickness; and wherein each of the two peripheral ribs are identical in length, width, and thickness.

5. The system of claim 4, wherein a first length of a central rib is greater than a second length of a peripheral rib, and a first width of the central rib is lower than a second width of the peripheral rib.

6. The system of claim 1, further comprising, a ledge formed at a base of the façade, the ledge jutting onto a base region of the inner portion, and a recess formed between the ledge and an inner wall of the inner portion.

7. The system of claim 6, wherein intake gas flows from the intake manifold to the intake port over the ribs and through the recess formed under the façade.

8. The system of claim 1, wherein the engine includes a plurality of the intake runners with each intake runner including the plurality of negative ribs arranged on the façade of the inner portion of the intake runner.

9. A system for an engine, comprising: an intake manifold including a plenum coupled to a plurality of intake runners, each intake runner including negative ribs formed along a wall of an inner portion of the intake runner and a recess formed under the wall allowing air flow from the plenum to an intake port of a cylinder, wherein negative ribs include a first set of coplanar central ribs and a second set of peripheral ribs, each rib in the first set of coplanar central ribs being longer than each rib in the second set of peripheral ribs, and wherein six negative ribs are formed along the wall of the inner portion of the intake runner.

10. The system of claim 9, wherein the inner portion of the intake runner includes a rim lining a perimeter of the intake runner, a plurality of vertically stacked segments, and the intake port formed at a second end of the intake runner, a first end of the intake runner being proximal to the plenum.

11. The system of claim 10, wherein the wall of the inner portion including the one or more negative ribs is arcuate with a width of the wall being higher at a center of the wall and the width of the wall decreasing towards two ends.

12. The system of claim 10, wherein the recess is formed between a base of the wall and another wall of the vertically stacked segments, the base of the wall projecting outward towards the second end of the intake runner from the another wall of the vertically stacked segments.

13. A method for an engine, comprising: flowing air from a plenum of an intake manifold to an intake port of a cylinder via each of a plurality of negative ribs formed on a façade of an inner portion of an intake runner and a recess formed below the façade of the inner portion, wherein each negative rib includes a trapezoidal cross section along a direction of air flow, each negative rib extending through a thickness of the façade, and wherein the recess is a rectangular area formed between a lower surface of the façade and an inner wall of the inner portion of the intake runner.

* * * * *